US006186460B1

(12) United States Patent
Lin

(10) Patent No.: US 6,186,460 B1
(45) Date of Patent: Feb. 13, 2001

(54) KEYBOARD SUPPORT ADJUSTING DEVICE

(76) Inventor: Chin-Chih Lin, 2F, No. 160, Shih Ta Road, Taipei (TW)

( * ) Notice: Under 35 U.S.C. 154(b), the term of this patent shall be extended for 0 days.

(21) Appl. No.: 09/286,938

(22) Filed: Apr. 7, 1999

(30) Foreign Application Priority Data

Mar. 15, 1999 (TW) ..... 88203831

(51) Int. Cl.[7] ..... E04G 3/00

(52) U.S. Cl. ..... 248/284.1; 248/278.1; 248/918

(58) Field of Search ..... 248/276.1, 278.1, 248/918, 279.1, 280.11, 284.1, 292.13; 108/6, 7, 138, 139, 141, 146

(56) References Cited

U.S. PATENT DOCUMENTS 5,257,767 * 11/1993 McConnell ..... 248/284.1
5,839,373 * 11/1998 Lin ..... 248/284.1 X
5,881,984 * 3/1999 Lin ..... 248/284.1
5,901,933 * 5/1999 Lin ..... 248/918 X
5,924,664 * 7/1999 Mileos et al. ..... 248/281.11
5,924,666 * 7/1999 Liu ..... 248/286.1

* cited by examiner

*Primary Examiner*—Anita M. King
*Assistant Examiner*—Gwendolyn Baxter
(74) *Attorney, Agent, or Firm*—Dougherty & Troxell

(57) ABSTRACT

A keyboard support adjusting device includes a rotary frame, two frame plates, a connecting seat, and two brackets. A shaft connects the frame plates to the rotary frame. The connecting seat is pivotally connected at one end to the rotary frame. The other end of the connecting seat has a projecting extension seat with a through seat hole in a transverse direction and a curved groove. A tightening device passes through the frame plates, the brackets and the curved groove. The brackets are disposed on both sides of the extension seat, each of which includes a vertical portion provided with a through hole and a curved opening, and a horizontal portion defining a bracket face that may be connected to a keyboard support.

20 Claims, 4 Drawing Sheets

KEYBOARD SUPPORT ADJUSTING DEVICE

BACKGROUND OF THE INVENTION (a) Field of the Invention

The present invention relates to an adjusting device for keyboard supports, more particularly to an adjusting device that, when the height of a keyboard support is being adjusted, allows keyboard support brackets to be displaced parallel therewith to thereby eliminate the need to adjust the elevation of the keyboard support.

(b) Description of the Prior Art

With the popularization of personal computers, tables and racks adapted for placement of computers and their peripheral equipment are also very popular. The so-called "computer table" generally includes a table surface for placement of a monitor and an adjustable platen for placement of a keyboard. The adjustable platen operates like a drawer. It can be pulled out to allow access to the keyboard or pushed in to conceal the keyboard below the table surface.

Conventional adjustable platens can only displace forwardly and rearwardly like a drawer and do not allow adjustment of height, angle of rotation, and elevation. Hence, they cannot match an individual user's sitting posture, the elevation and height of their hands when keying in, or physique to allow sidewise deviation corresponding to a sitting posture.

Many solutions have been offered to try to solve the above-mentioned problems with conventional keyboard supports and to provide an ergonomic keyboard support to prevent possible damage to the user due to improper posture, for instance, U.S. Pat. Nos. 4,616,798, 5,257,676, and U.S. Des. 306,239. In addition, in U.S. Pat. No. 5,839,373 and allowed U.S. Ser. No. 08/879,769 owned by the inventor of the present invention, use of the conventional adjustable platen is eliminated and an all-dimensional adjusting device allowing adjustment of forward and rearward displacement, height, and elevation of a keyboard support.

SUMMARY OF THE INVENTION

A primary object of the present invention is to provide a keyboard support adjusting device that allows keyboard support brackets to displace in a parallel manner during adjustment of the height of a keyboard support, thereby eliminating the need to re-adjust the elevation of the keyboard support.

BRIEF DESCRIPTION OF THE DRAWINGS

The foregoing and other features and advantages of the present invention will be more clearly understood from the following detailed description and the accompanying drawings, in which, FIG. 1 an exploded perspective view of a preferred embodiment of an adjusting device of the present invention.

DETAILED DESCRIPTION OF THE PREFERRED EMBODIMENT

Figure 1:
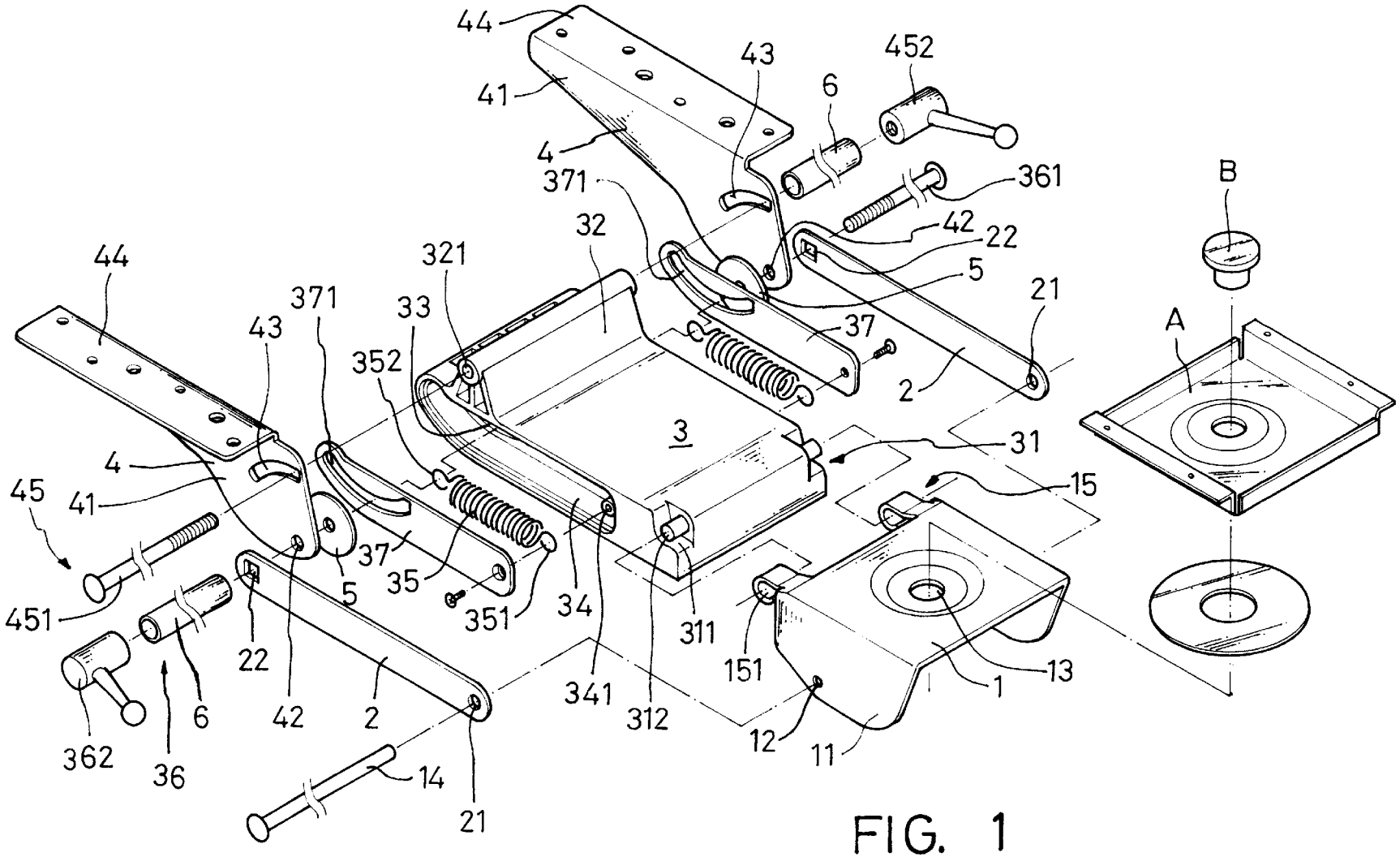
Figure 2:
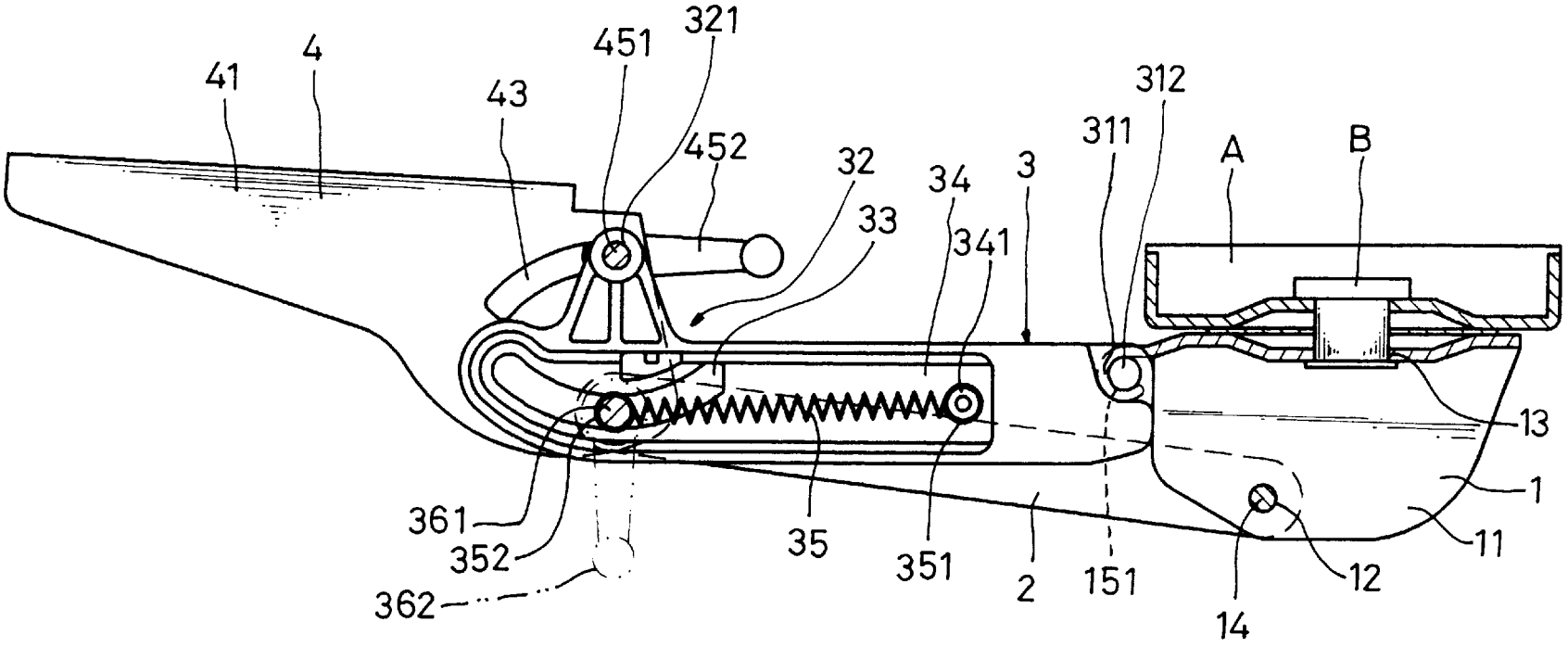
FIG. 2 is an assembled side view of the preferred embodiment.
Figure 3:
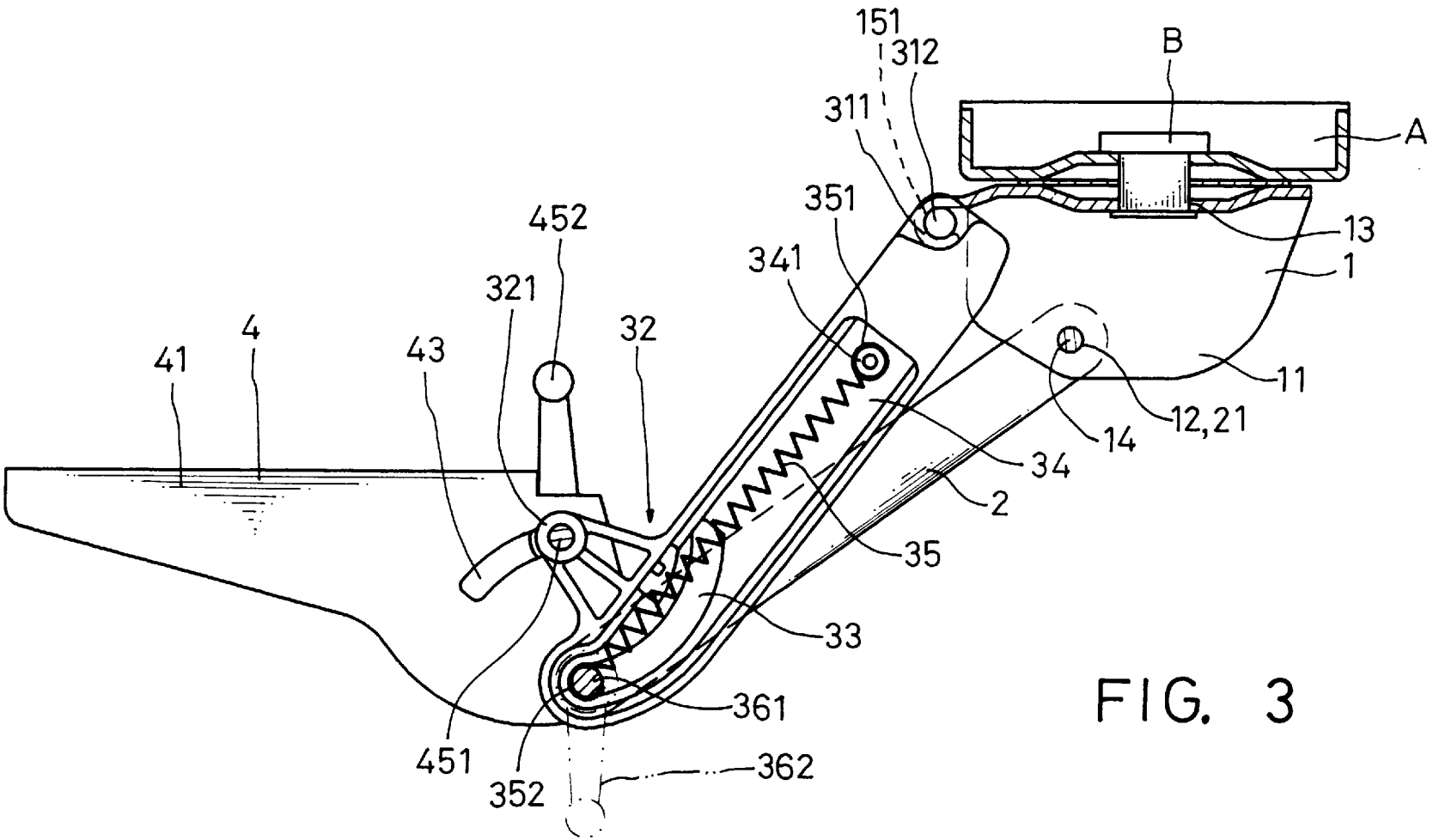
FIG. 3. is a side view illustrating the preferred embodiment during elevation.
Figure 4:
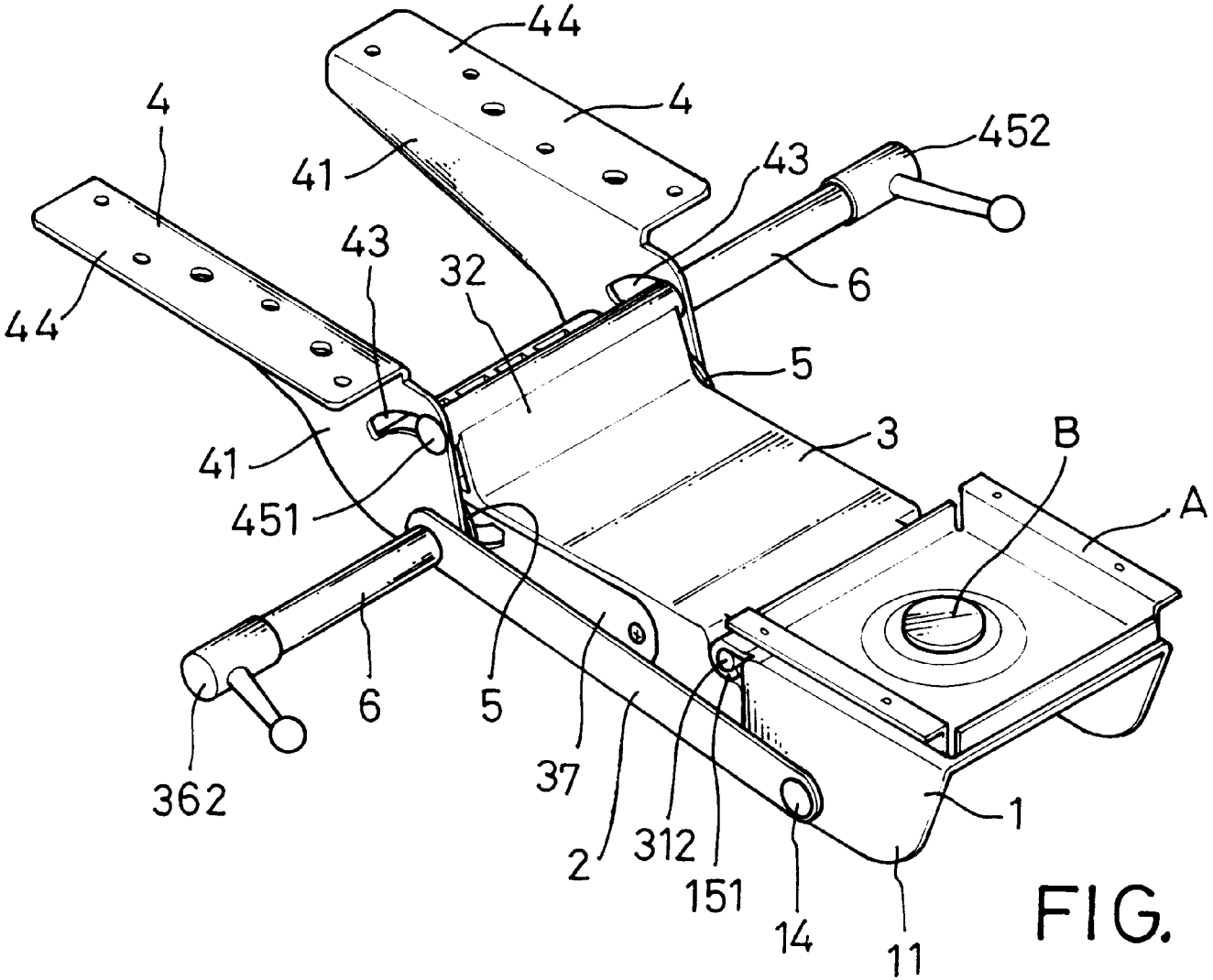
FIG. 4 is an assembled perspective of the preferred embodiment.

With reference to FIGS. 1 to 4, a preferred embodiment of an adjusting device according to the present invention is shown to comprise a rotary frame 1, two frame plates 2, a connecting seat 3, and two brackets 4.

The rotary frame 1 is an inverted U-shaped structure that has two side wings 11 provided with symmetrical wing holes 12, respectively, and an upper side provided with a frame hole 13 adapted for connection with a fixed plate A disclosed in U.S. Pat. No. 5,881,984. The rotary frame 1 and the fixed plate A are riveted together by means of a spindle B such that the rotary frame 1 can deviate sideways with respect to the fixed plate A. A shaft 14 passes through wing holes 12 and end holes 21 at ends of the two frame plates 2 on both sides of the rotary frame 1 to connect each of the frame plates 2 to one side of the rotary frame 1. In addition, a pivotal connecting means 15 projects from a front end of the rotary frame 1. In this preferred embodiment, the pivotal connecting means 15 includes two frame hooks 151 adapted for connection with the connecting seat 3.

The frame plates 2 are flat, straight plates. Each frame plate 2 has the above-mentioned end hole 21 through which the above-mentioned shaft 14 passes to pivotally connect the frame plate 2 to the rotary frame 1. A plate hole 22 is formed at the other end of the frame plate 2. A tightening means 36 is used to pivotally connect the plate hole 22 to one side of the connecting seat 3.

The connecting seat 3 is an elongated seat sized to match the distance between inner walls of the frame wings 11. The connecting seat 3 is provided with a coupling means 31 at one end corresponding to the frame hooks 151 of the pivotal connecting means 15. The coupling means 31 includes indentations 311 on each side of the connecting seat 3, and posts 312 projecting from the respective indentations 311. By means of this arrangement, when the rotary frame 1 and the connecting seat 3 are coupled, the connecting seat 3 can turn at one end on the rotary frame 1. The other end of the connecting seat 3 is integrally formed with an extension seat 32 that is internally provided with a through seat hole 321 for pivotal connection with the brackets 4. The extension seat 32 is further provided with a through curved groove 33 at a lower end thereof for passage of a tightening means 36. Alternatively, as shown in this preferred embodiment, a side groove 34 is formed on either lateral side of the connecting seat 3. The side groove 34 has a spring post 341 projecting from one end thereof opposite to the curved groove 33. A spring 35 has a fixed end 351 fitted on the spring post 341 and an opposite movable end 352 for passage and pivotal connection of the tightening means, and is disposed on one side of a bottom end of the curved groove 33.

In order to conceal the side grooves 34 so as to prevent the springs 35 from slippage, two sealing covers 37 of substantially the same shape and size as the side grooves 34 are respectively coupled to the side grooves 34 to cover the same. Each sealing cover 37 is further formed with a curved slot 371 corresponding to the curved groove 33 and having the same curvature. A shaft element 361 of the tightening means 36 passes through the two brackets 4, plate holes 22 of the frame plates 2, curved slots 371 of the sealing covers 2, movable ends 352 of the springs 35, and the curved groove 33, respectively, to have an end thereof coupled with a knob portion 362. Hence, by turning the knob portion 362, all the components pivotally connected by the shaft element 361 can be tightened or loosened to allow height adjustment.

The brackets 4 are structures generally L-shaped disposed on both sides of the extension seat 32. Each bracket 4 includes a vertical portion 41 and a horizontal portion. As shown, the vertical portion 41 is formed with a through hole 42 and a curved opening 43. The horizontal portion defines a bracket face 44 for connection with a keyboard support (such as that disclosed in U.S. Pat. No. 5,704,698 owned by the inventor of the present invention).

In use, the through holes 42 are located at a bottom end of the vertical portion 41, are passed through by the shaft element 361 to form a spindle. A connecting element 451 of a connecting means 45, such as a screw rod, passes through the curved opening 43 and the seat hole 321, with an end portion connected to a knob 452. By turning the knob 452, the brackets 4 can be tightened or loosened to allow elevation adjustment. Alternatively, when the curved openings 43 are located at the bottom end of the vertical portions 41, they are passed through by the shaft element 361, and the through holes 42 are directly locked to the seat hole 321 by the connecting element 451 to form a spindle, whereby the curved opening 43 can displace along the tightening means 36 to proceed with elevation adjustment.

In order to achieve a preferred tightening effect, an urging plate 5 may be disposed between the through hole 42 (or curved opening 43) and curved groove 33 of the connecting seat 3. The urging plate 5 is made of rigid elastic plastic material to achieve a preferred clamping effect.

In order to facilitate operation of the knob portion 362 and the knob 452, an urging tube 6 may be disposed between the knob portion 362 or knob 452 and the respective ones of the frame plates 2 and brackets 4 for passage of the shaft element 361 or connecting element 451 so as to lengthen the operating distance of the knob portion 362 and knob 452 and prevent contact with the adjusting device.

Referring to the drawings, in actual use, the user can simply hold the keyboard support placed below the table surface and pull it outwardly. The user may then move the keyboard support to the left or right so that the rotary frame 1 utilizes the spindle B on the fixed plate A as an axis and displaces to a certain angle to achieve angle adjustment. The user can then loosen the knob portion 362 and hold the keyboard support downwardly to directly perform height adjustment. At this time, one side of the connecting seat 3 utilizes the post 312 and the frame hook 151, as well as the end holes 21 of the two frame plates 2 and the shaft 14 as an axis, so that during downward displacement of the connecting seat 3, the shaft element 361, being restricted by the length of the frame plates 2, can only displace towards the front of the curved groove 33. When the desired operating height is achieved, the knob portion 362 can be turned tight so that the shaft element 361 is received in a suitable position of the curved groove 33. Height adjustment is therefore accomplished. Alternatively, as shown in the figures, the shaft element 361 can be pivotally connected to the movable ends 352 of the two springs 35, with the other end fixedly provided on the spring post 341. Therefore, when the shaft element 361 displaces along the curved groove 33, the springs 35 will be stretched to achieve height adjustment. Finally, the knob 452 of the connecting means 45 is loosened, and the keyboard support can be directly adjusted by causing the curved openings of the brackets 4 to displace along the connecting element 451 so as to position the operating angle of elevation.

On the contrary, when use is not desired, the knob portion 362 is loosened so that the springs 35, being released, reset to the bottom ends of the curved groove 33, and the connecting seat 3 automatically elevates. The knob portion 362 can then be tightened, and the keyboard support is pushed in a reverse direction so that the fixed plate A slides along a track unit, allowing the keyboard to be concealed below the table surface. Since the brackets 4 are provided above the connecting seat 3, it can displace parallel to the connecting seat 3. Therefore, when the angle of elevation of the brackets 4 is set, there is no need to make any elevation adjustment when the keyboard support is to be used again.

In view of the aforesaid, it can be appreciated that the present invention is simple to operate, and the positioning effects are excellent. Besides, due to the arrangement of springs in the side grooves on both sides of the connecting seat, the keyboard support can automatically reset to position when not in use. Furthermore, after an angle of elevation is set, it is not necessary to re-adjust it in subsequent operations.

Although the present invention has been illustrated and described with reference to the preferred embodiment thereof, it should be understood that it is in no way limited to the details of such embodiment but is capable of numerous modifications within the scope of the appended claims.

What is claimed is:

1. A keyboard support adjusting device, comprising:

a rotary frame having a substantially inverted U-shape with two side wings respectively provided on sides thereof, and a pivotal connection provided at a front end thereof, said side wings being provided with symmetrical wing holes, respectively;

two frame plates, each of which has an end hole at one end and a plate hole at an opposite end, a shaft passing through said end holes and said wing holes to pivotally connect said frame plates to said rotary frame;

a connecting seat having a rear side pivotally connected to said pivotal connection of said rotary frame, a front side of said connecting seat being provided with a projecting extension seat, said extension seat having a through seat hole in a transverse direction and a curved groove disposed below said through seat hole;

two brackets, each being substantially L-shaped and disposed on opposite sides of said extension seat, each of said brackets including a first portion and a second portion, said first portion being provided with a through hole and a curved opening; a tightening device passing through said frame plates, one of said through hole and said curved opening of said brackets, and said curved groove; and a connecting device passing through the other of said curved opening and said through hole, whereby said curved openings enable elevation adjustment, said second portions of said brackets defining bracket faces;

whereby said tightening device can be loosened to allow downward adjustment of said front end of said connecting seat so that said tightening device can only be displaced towards a front end of said curved groove, said tightening device being tightened after such adjustment to position said connecting seat.

2. The keyboard support adjusting device as defined in claim 1, wherein said pivotal connection of said rotary frame includes indentations on both sides of said connection seat, each of which having a post projecting therefrom engaging a respective frame hook on said rotary frame, whereby said connecting seat is pivotable relative to said rotary frame.

3. The keyboard support adjusting device as defined in claim 1, wherein said connecting seat further comprises a side groove provided on each side thereof, respectively, said side grooves being covered by corresponding sealing covers that are shaped and sized to correspond to said side grooves, said sealing covers being provided with curved slots having a same curvature as said curved groove in said connection seat for passage of said tightening device.

4. The keyboard support adjusting device as defined in claim 1, wherein said tightening device includes a shaft element passing through said frame plates, said brackets, and said curved groove, with an end portion threaded into a knob portion.

5. The keyboard support adjusting device as defined in claim 4, further comprising a tightening tube pivoted between said knob portion of said tightening device and one of said frame plates, said shaft element passing through said tightening tube.

6. The keyboard support adjusting device as defined in claim 1, wherein said connecting device includes a connecting element passing through said curved openings of said brackets and said seat hole of said projecting extension seat, with an end portion threaded into a knob.

7. The keyboard support adjusting device as defined in claim 6, further comprising a tightening tube provided between said knob of said connecting device and one of said frame plates, said connecting element passing through said tightening tube.

8. The keyboard support adjusting device as defined in claim 1, wherein said connecting device includes a connecting element passing through said through holes of said brackets to be connected to said seat hole of said extension seat, with said tightening device passing through said curved openings of said brackets.

9. The keyboard support adjusting device as defined in claim 1, further comprising an urging plate disposed between at least one of said brackets and said connecting seat, to achieve enhanced clamping and positioning effects.

10. The keyboard support adjusting device as defined in claim 9, wherein said urging plates are formed from rigid elastic plastic material.

11. A keyboard support adjusting device, comprising:

a rotary frame having a substantially inverted U-shape with two side wings respectively provided on sides thereof, and a pivotal connection provided at a front end thereof, said side wings being provided with symmetrical wing holes, respectively;

two frame plates, each of which has an end hole at one end and a plate hole at an opposite end, a shaft passing through said end holes and said wing holes to pivotally connect said frame plates to said rotary frame;

a connecting seat having a rear side pivotally connected to said pivotal connection, a front side of said connecting seat being provided with a projecting extension seat, said extension seat having a through seat hole in a transverse direction, a side groove formed on either lateral side thereof, said side groove having a spring post projecting from a first end thereof, a spring having a first end attached to said spring post and a second end being a movable end located at a bottom end of a through curved groove located at a second end of said side grooves, and a tightening device passing through said frame plates, said two brackets, said springs, and said curved groove;

two brackets, each being substantially L-shaped and disposed on opposite sides of said extension seat, each of said brackets including a first portion and a second portion, said first portion being provided with a through hole and a curved opening, said tightening device passing through said frame plates, one of said through hole and said curved opening of said brackets, and said curved groove; and a connecting device passing through the other of said curved opening and said through hole, whereby said curved openings enable elevation adjustment, said second portions defining bracket faces;

whereby said tightening device can be loosened to allow downward adjustment of said front end of said connecting seat so that said tightening device can only be displaced towards a front end of said curved groove to stretch said springs, said tightening device being tightened after such adjustment to position said connecting seat.

12. The keyboard support device as defined in claim 11, wherein said pivotal connection of said rotary frame includes indentations on both sides of said connection seat, each of which having a post projecting therefrom engaging a respective frame hook on said rotary frame, whereby said connecting seat is pivotable relative to said rotary frame.

13. The keyboard supporting device as defined in claim 11, further comprising a sealing cover covering each of said side grooves, said sealing covers being shaped and sized to match said side grooves and to prevent slippage of said springs, said sealing covers having curved slots having a same curvature as said curved groove in said connections eat for passage of said tightening device.

14. The keyboard support adjusting device as defined in claim 11, wherein said tightening device includes a shaft element passing through said frame plates, said brackets, and said curved groove, with an end portion threaded into a knob portion.

15. The keyboard support adjusting device as defined in claim 14, further comprising a tightening tube provided between said knob portion of said tightening device and one of said frame plates, said shaft element passing through said tightening tube.

16. The keyboard support adjusting device as defined in claim 11, wherein said connecting device includes a connecting element passing through said curved openings of said brackets and said seat hole of said projecting extension seat, with an end portion threaded into a knob.

17. The keyboard support adjusting device as defined in claim 16, further comprising a tightening tube provided between said knob of said connecting device and one of said frame plates said connecting element passing through said tightening tube.

18. The keyboard support adjusting device as defined in claim 11, wherein said connecting device includes a connecting element passing through said through holes of said brackets to be connected to said seat hole of said extension seat, with said tightening device passing through said curved openings of said brackets.

19. The keyboard support adjusting device as defined in claim 11, further comprising an urging plate disposed between at least one of said brackets and said connecting seat, to achieve enhanced clamping and positioning effects.

20. The keyboard support adjusting device as defined in claim 19, wherein said urging plates are formed from rigid elastic plastic material.

* * * * *